US005307635A

United States Patent [19]

Graves et al.

[11] Patent Number: 5,307,635

[45] Date of Patent: May 3, 1994

[54] FUEL NOZZLE WITH COMBINED RADIAL AND AXIAL BELLOWS

[75] Inventors: Charles Graves; Todd Neill, both of Jupiter, Fla.; Raman Ras, Oakwood, England; Kiran Patwari, Highland Heights; Robert T. Mains, Euclid, both of Ohio; Curtis H. Scheuerman, Newbury, Ohio

[73] Assignee: United Technologies Corporation, Hartford, Conn.

[21] Appl. No.: 968,627

[22] Filed: Oct. 29, 1992

[51] Int. Cl.[5] ..... F02C 7/22

[52] U.S. Cl. ..... 60/740; 239/397.5

[58] Field of Search ..... 60/39.32, 740, 741; 239/405, 403, 397.5

[56] References Cited

U.S. PATENT DOCUMENTS 4,258,544 3/1981 Gebhart ..... 60/39.32

4,817,873 4/1989 McKay ..... 239/397.5

*Primary Examiner*—Richard A. Bertsch

*Assistant Examiner*—W. J. Wicker

*Attorney, Agent, or Firm*—Norman Friedland

[57] ABSTRACT

A fuel nozzle for the combustor of gas turbine engines includes evacuated radial and axial bellows concentrically mounted to the fuel passages to prevent coking of the fuel passages and maintain the structural integrity of the integral parts and particularly the weld joints and the method of construction is disclosed.

7 Claims, 5 Drawing Sheets

FUEL NOZZLE WITH COMBINED RADIAL AND AXIAL BELLOWS

TECHNICAL FIELD

This invention relates to fuel nozzles for a gas turbine engine and more particularly to the construction of the fuel nozzles to prevent coking of the fuel passages and to maintain its structural integrity.

BACKGROUND OF THE INVENTION

As is well known in the gas turbine engine field of technology the fuel nozzles for the engine's combustor have the propensity of coking and the severity of the problem increases as the fuel and/or compressor discharge air temperature increases. Of course, for efficient combustion and engine performance, it is desirable to operate the engine at the highest possible turbine inlet temperature in order to achieve optimum engine performance. Hence to be compatible with this prerequisite, it is abundantly important to eliminate or minimize coking to assure that the fuel passageways of the fuel nozzles remains relatively clean and free from coke build-up. Military aircraft and particularly those classified as fighter aircraft are continuously increasing their speed requirements, necessitating the increased temperature requirements imposed on the engine's components.

Obviously, this has created significant burdens and challenges on those faced with the problems of combating these high temperature requirements while at the same time providing high performing and reliable engines powering these aircraft.

It is well known that one of the methods for preventing coking is by keeping the wetted wall temperature of the fuel passageways below a maximum temperature of, say 400 degrees Fahrenheit. Since the temperature of the compressor discharge air to which the fuel nozzle is subjected may get as high as 1600 degrees Fahrenheit, a known method of maintaining the wetted wall temperature at a tolerable level is by insulating the fuel nozzle. One way that has proven to be satisfactory is by insulating the fuel nozzle by incorporating an evacuated jacket that separates the high temperature surfaces of the fuel nozzle from the lower temperature surfaces that are in contact with the fuel.

This approach at these temperature levels has been evaluated and although the evacuated jacket maintains the wetted wall temperature to acceptable levels, the thermal gradients in the fuel nozzle was shown to be exceedingly high which created exceedingly high axial stresses that could only be alleviate by use of axial bellows. The prior art exemplifies different fuel nozzle designs that incorporate axial bellows. However, not all the designs utilize the bellows to prevent undue axial levels of stress. For example, U.S. Pat. No. 4,295,452 granted to M. Lembke et al on Oct. 20, 1981 utilizes an axial bellows that serves to dampen the noise created by the fuel injection valve operation. U.S. Pat. No. 3,234,731 granted to D. J. Dermody et al on Feb. 15, 1966 utilizes a pair of axial bellows to achieve a desired sealing characteristic for its dual fuel nozzle. U.S. Pat. No. 4,409,791 granted to G. E. A. Jourdain et al on Oct. 18, 1983 likewise utilizes an axial bellows for sealing. Axial bellows are known in the art for use as density and/or viscosity compensators. Use of bellows to compensate for expansion and contraction to reduce stress on the structural components are exemplified in U.S. Pat. No. 4,258,544 granted to D. E. Gebhart et al on Mar. 31, 1981 and in U.S. Pat. No. 4,384,846 granted to R. Walderhofer on May 24, 1983.

However, none of these patents suggest the use of the combination of axial and radial bellows or the use of radial bellows by itself to solve the thermal stresses occasioned in a high temperature environment to which the fuel nozzle disclosed in the present patent application is subjected. This invention contemplates the use of radial bellows to solve the thermal stress problems.

In investigation of the present invention it was found through structural and thermal analysis that the thermal gradient in the fuel nozzle tip exceeded 1200 degrees fahrenheit in a quarter of inch of radius. Such would be the case for any design that successfully insulated the fuel passages. However, the large thermal gradient in the tip resulted in unacceptable stress levels in the nozzle, particularly at the weld joints. This presented a serious problem since it included a weld joint that was critical to the design of the fuel nozzle.

SUMMARY OF THE INVENTION

We had found that we could obviate the problems alluded to in the above by including a radial bellows judiciously located in an area in the tip of the fuel nozzle that was subjected to high stress levels.

An object of this invention is to provide an improved fuel nozzle for the combustor of a gas turbine engine which is characterized by means for eliminating or minimizing coking of the fuel passageways while maintaining the structural integrity of the structure.

A feature of this invention is to include a radial bellows adjacent the exit tip of the fuel nozzle which provides a vacuum between the outer wall of the fuel nozzle emersed in the ambient environment and the inner wall defining the fuel delivery passageway.

A still further feature of this invention is to provide a radial bellows in combination with an axial bellows to absorb the stresses occasioned by the high thermals to which the fuel nozzle is subjected.

A still further object is to provide improved means for minimizing or eliminating coking of the fuel passageways in a fuel nozzle that includes both the primary and secondary fuel passageways and an evacuated chamber defined in part by an axial and radial bellows.

The foregoing and other features of the present invention will become more apparent from the following description and accompanying drawings.

BEST MODE FOR CARRYING OUT THE INVENTION

Figure 1:
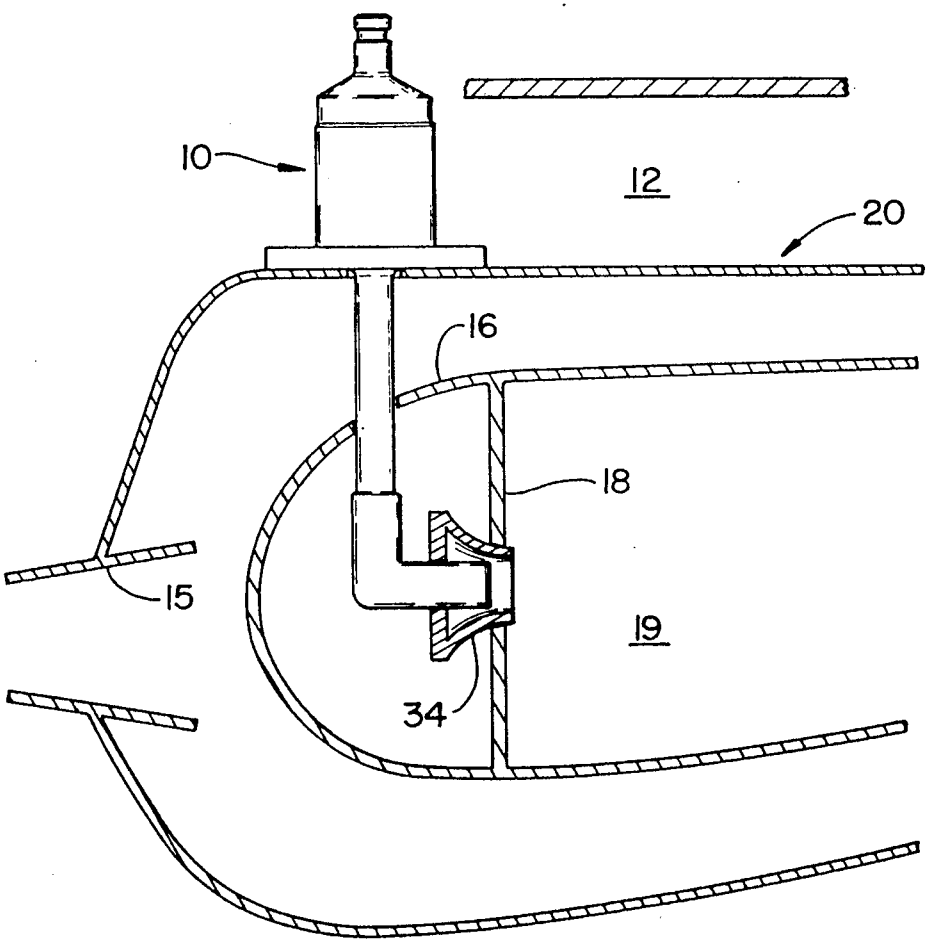
FIG. 1 is a partial view partly in elevation and partly in schematic illustrating a preferred embodiment of the invention.

As best seen in FIG. 1, the fuel nozzle generally illustrated by reference numeral 10 serves to deliver primary and secondary fuel to the combustor 20 and as noted the fuel nozzle passes through the fan discharge duct 12, through the shrouded annular passageway 14 that flows compressor air from the compressor (not shown), through the diffuser 15, through the combustor hood 16, through the housing 18 and into the combustion zone 19 of combustor 20. The fuel nozzle is attached in a well known and suitable manner and for the sake of convenience and simplicity a detail explanation thereof is omitted herefrom. It will however be appreciated that certain portions of the fuel nozzle are emersed in different temperature zones of the engine which exhibit varying levels of heat extending from the most extreme high temperature condition to a relatively cool temperature condition. As is apparent from FIG. 1, fuel nozzle 10 sees the very high temperature exhibited in combustion zone 19 and the relatively low temperature exhibited at the nozzles inlet in fan air discharge duct 12.

Figure 2:
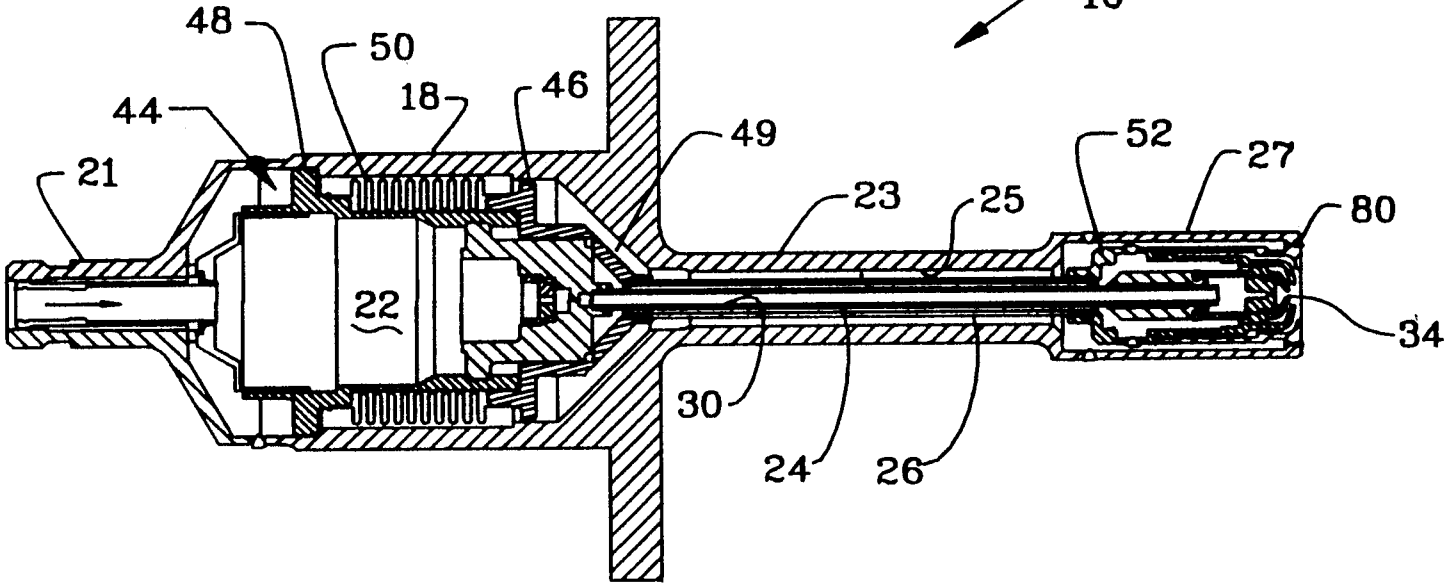
FIGS. 2 and 2*a* are views partly in section and partly in elevation indicating the details of the invention.
Figure 2A:
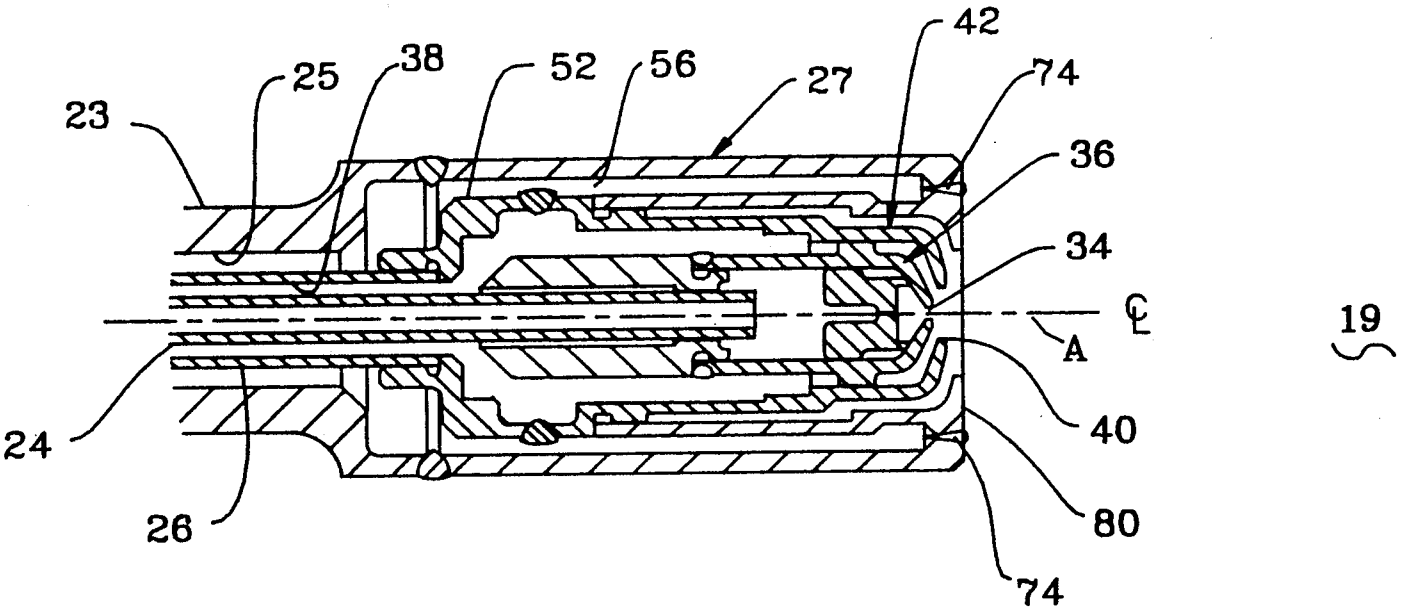

As noted in FIG. 2, fuel nozzle 10 comprises a generally cylindrically shaped main housing 18 that extends along the fuel nozzle's longitudinal axis A and defines a central passage. Main housing 18 necks down to a narrower diameter to define an inlet section 21 suitably attached to a fuel line (not shown) for delivering the fuel to a suitable metering valve 22 (shown in blank). Valve 22 serves to deliver primary and secondary fuel to the combustor as will be described hereinbelow.

Main housing 18 downstream of valve 22, again, necks down to a smaller diameter portion 23 for defining central passage 25 for accommodating the fuel delivery passages connecting the inlet to the combustor. To this end, a pair of concentric tubes 24 and 26 are coaxially mounted about the longitudinal axis A in central passage 25 where the inner tube 24 delivers the primary fuel and the outer tube 26 delivers the secondary fuel. The nozzle orifices which are formed in the tip portion 27 of the fuel nozzle 10 are suitably attached, say by welding, at the ends of main housing 18 and tubes 24 and 26, as best seen in FIG. 2.

As is apparent from the foregoing, the primary fuel from valve 22 enters the inner duct 24, flows through the hollow passage 30 and discharges into the combustion zone 19 through the orifice 34 of nozzle tip portion 36. The secondary fuel flows through the annular passageway 38 that is formed between the outer tube 26 and the inner tube 24 and discharges into combustion zone 32 through the orifice 40 of nozzle tip portion 42.

As was mentioned in the above, in order to prevent any significant blockage of the fuel passages from coke build-up it is necessary to keep the wetted wall temperature to a relatively low temperature, say 400 degrees Fahrenheit. Inasmuch as the temperature in the environment can get as high as say, 1600 degrees F. One way of achieving the low temperature of the wetted walls is to insulate the fuel nozzle with an evacuated jacket separating high temperature surfaces from surfaces in contact with the fuel. The inner housing generally indicated by reference numeral 44 serves this purpose.

As noted from FIG. 2, the inner housing consists of the annular wall member 46 disposed at the larger diameter portion of main housing 18, annular wall member 48 having a smaller diameter end portion 50 connecting the outer tube 26, and the nozzle tip portion 52 connected to the other end of outer tube 26 defining as an integral unit with inner surface 54 of main housing 18 an annular cavity or shroud 56. As is apparent from FIG. 2. the inner housing is concentrically mounted relative to the outer housing and is mounted relative to the main housing 18 such that it is in axial sliding relationship thereto. The axial bellows 50 interposed between and connected to the annular wall members 46 and 48, respectively, forms a contiguous cavity 56 separating the inner housing 48 and main housing 18. Cavity 56 is evacuated as will be described in further detail hereinbelow. The axial bellows 50 serves to relieve the large axial stresses occasioned by the varying temperature levels encountered. As will be appreciated the axial bellows 50 contract and expand as the inner housing 44 shrinks and expands in response to these thermals.

Notwithstanding the fact that the evacuated jacket maintain an acceptable temperature of the wetted walls, because the fuel nozzle tip exceeded a very high temperature of say, 1200 degrees F. in a quarter of an inch of radius, certain structural problems were evident. In particular the welds 58 for joining the tube to the nozzle tip portion components of the fuel nozzle evidenced unacceptable stress levels.

In accordance with this invention radial bellows generally indicated by reference numeral 60 is placed in the area of high stress. While the axial bellows separates the hot part of the main housing 18 from the cold part of the outer tube 26 and inner tube 24, both bellows, cooperatively, allow the outer tube 24 to follow the main housing 18 as it grows during heat-up, thus, relieving stress from axial growth.

This can best be appreciated by referring to FIGS. 3, 3A, 4 and 4A which show the nozzle tip section of the fuel nozzle 10 constructed in one configuration with only the axial bellows 50 and in another configuration with both the axial 50 and radial bellows 60, respectively. The radial bellows 60 (shown in the dash outline of FIG. 4) include connector wall members 62, 64 and 66, and inner and outer convolutes 68 and 70, respectively, surrounding the primary and secondary fuel passages. This construction allows expansion and contraction in the radial direction, i.e. the direction normal to longitudinal axis A, as shown. As noted the inner ends of walls 64 and 66 are suitably welded to the extremities of outer tube 26 and main housing 18 as depicted by welds 58, 80 and 59. The annular walls 70 and annular walls 62 and 64 together with convolute 68 define an open chamber 72 which communicates with ambient.

Figure 4:
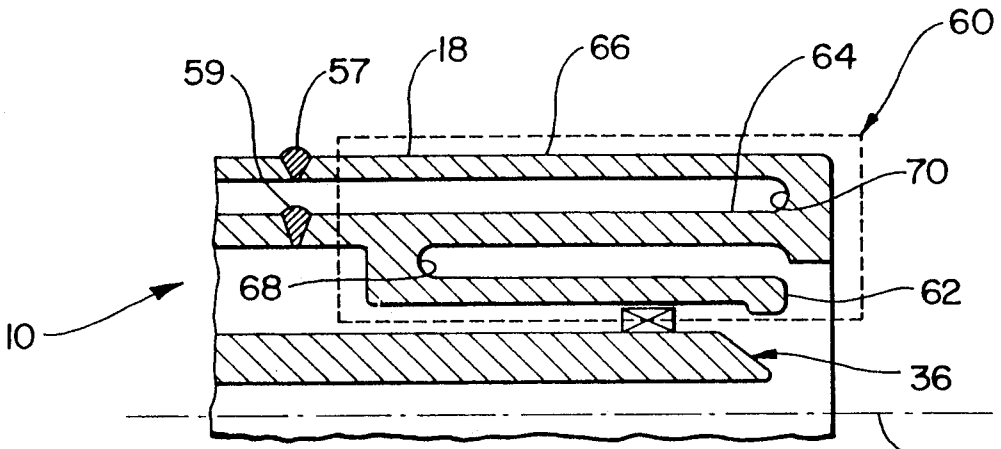
FIG. 4 is an enlarged partial view of the nozzle tip configured similar to the embodiment shown in FIG. 3 incorporating this invention and illustrating the condition before heat is applied.
Figure 4A:
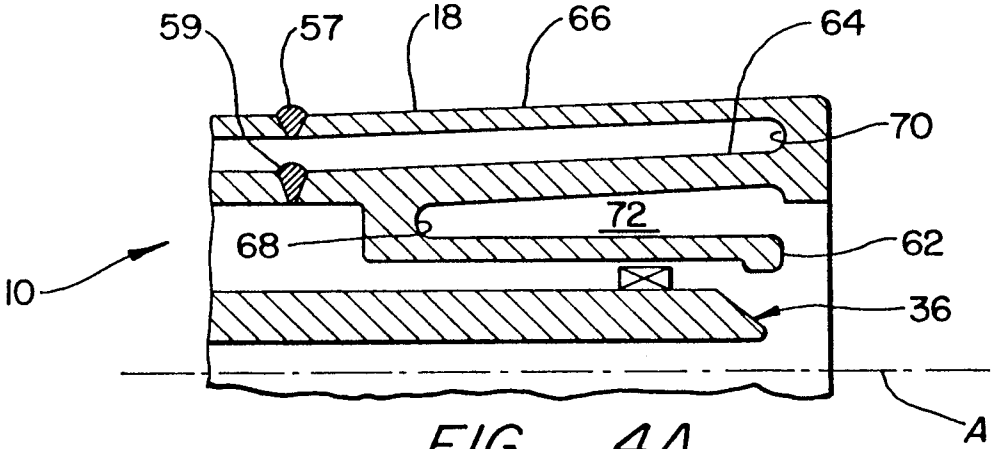
FIG. 4A is an enlarged view identical to the nozzle depicted in FIG. 4 illustrating the condition after heat is applied to demonstrate the difference between the deformed and undeformed conditions.

FIG. 4 shows the radial bellows in the relaxed state when there is virtually no heat differential (isothermal) and FIG. 4A shows the radial bellows in the deformed state when there is a high thermal load.

Figure 3:
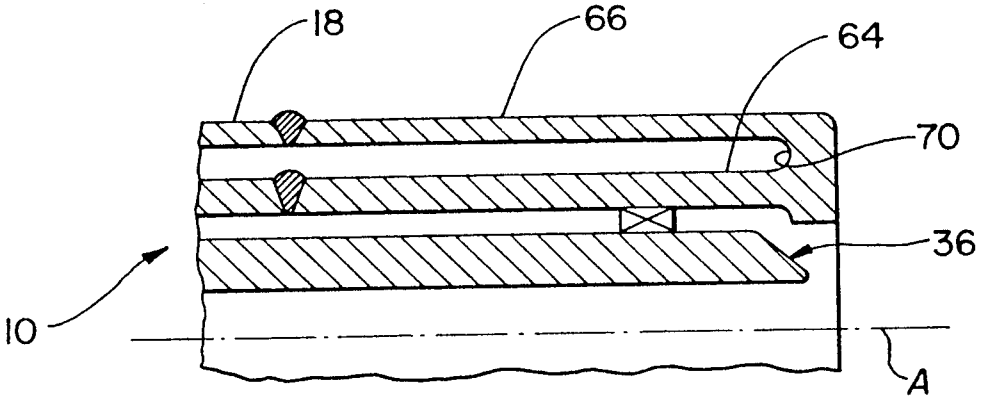
FIG. 3 PRIOR ART
FIG. 3 is an enlarged partial view of the nozzle tip illustrating a prior art embodiment without the invention before heat is applied to demonstrate deformed and state.

When compared with the structure in FIG. 3 which is constructed without the radial bellows, it will be observed that there is evidenced a shorter conduction path and a high stress area at the convolute 70. (Like reference numerals refer to like elements in all the Figures).

Figure 3A:
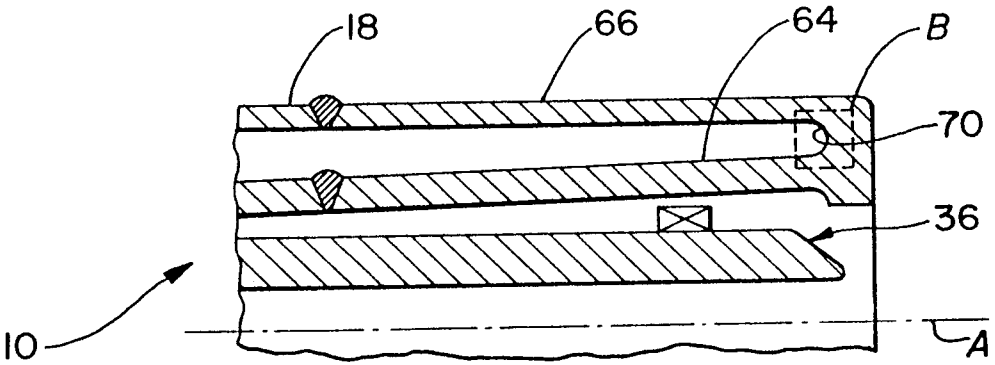
FIG. 3A PRIOR ART
FIG. 3A is an enlarged view of a prior art embodiment of a nozzle tip identical to the configuration in FIG. 3 after heat was applied to show the structure after it was deformed to illustrate the difference between the two conditions.

The construction of FIGS. 3 and 3A without the radial bellows shows the nozzle tip portion comprising annular walls 66 and 64 surrounding the primary and secondary fuel passages. As will be appreciated by observing FIG. 3A, when in the deformed condition owing to the high thermal loads, the annular walls 66 and 64 at the end remote from convolute 62 tend to widen and exert a high stress at the convolute 70, emphasized by the dash line B. This turns out to be the area where failure is most likely to occur.

As is apparent from the foregoing, the use of the radial bellows 60 increases the conduction path from the secondary fuel passage to the main housing 18, thus, evidencing a lower temperature of the secondary wetted wall. Additionally, the low thermal expansion of annular wall 62 and high thermal expansion of annular walls 64 and 66 serve to distribute the stresses to convolute 68 and 70 so that they both share the stress induced by the thermal expansion.

In order to evacuate the cavity 56, the fuel nozzle 10 is first assembled and then placed in an evacuated chamber associated with an electron beam welding apparatus (not shown). The chamber is then evacuated to the vacuum level desired, say to in the order of one micron height of a column of mercury. As seen in FIG. 2, the aft end of main housing 18 which includes a depending member 81 defining the frontal face of the fuel nozzle and an opening that exposes cavity 56 to the vacuum. This opening is then welded, in situ, sealing chamber 56, as indicated by the weld 58. By virtue of this operation, both the axial and radial bellows are evacuated.

Although the invention has been shown and described with respect to detailed embodiments thereof, it will be understood by those skilled in the art that various changes in form and detail thereof may be made without departing from the spirit and scope of the claimed invention.

What is claimed:

1. A fuel nozzle for a gas turbine engine including a generally cylindrical housing defining an axial central passage, First fuel delivery means including an axially extending tubular member having ends and having a first nozzle on one end and being disposed along the axis of said central passage defining a first passageway for delivering primary fuel.

Second fuel delivery means including another tubular member having ends concentrically disposed relative to said axially extending tubular member including a second nozzle on one end defining a second passageway for delivering secondary fuel, said housing including a cylindrically shaped wall encapsulating said first passageway and said second passageway and defining with said other tubular member an annular evacuated chamber, an axial bellows attached to one end of said other tubular member remote from said second nozzle, and a radial bellows attached to said other tubular member adjacent said second nozzle, said first nozzle includes a complimentary tubular member defining an orifice for discharging primary fuel, and said second nozzle also includes another complementary tubular member defining another orifice for discharging secondary fuel and bonding means for joining said tubular member to said complementary tubular member and said other tubular member to said other complementary tubular member whereby said radial bellows relieves the thermal stress on said bonding means occasioned when said primary and/or secondary fuel flows through said orifice and/or said other orifice, said radial bellows includes a first annular wall concentrically disposed relative to said primary and secondary fuel passageways and a second annular wall concentrically disposed relative to said first annular wall and a convolute interconnecting said first annular wall and said second annular wall at one end and defining an open ended annular cavity for receiving ambient air therein,

2. A fuel nozzle as claimed in claim 1 wherein said fuel nozzle includes a frontal face portion, said housing having a depending portion defining a portion of said frontal face portion and enclosing one end of said evacuated cavity and means in situ for evacuating said cavity including an opening in said depending portion, and weld means for sealing said opening upon said cavity being evacuated.

3. In combination, a fuel nozzle and combustor for a gas turbine engine which engine includes a fan discharge duct and a shroud disposed between said fan discharge duct and said combustor, said combustor defining a combustion zone, said fuel nozzle having a generally cylindrical housing defining an axial central passage disposed about a longitudinal axis, means including an axially extending tubular member having ends and having a first nozzle on one end and being disposed in said axial central passage defining a first passageway for delivering primary fuel into said combustion zone.

additional means including another tubular member having ends concentrically disposed relative to said axially extending tubular member including a second nozzle on one end defining a second passageway for delivering secondary fuel into said combustion zone, said housing including a cylindrically shaped wall encapsulating said first passageway and said second passageway and defining with said other tubular member an annular evacuated chamber whose pressure is substantially below the ambient pressure, an axial bellows forming a portion of said evacuated chamber attached to one end of said other tubular member remote from said second nozzle, and a radial bellows also forming a portion of said evacuated chamber having an axis normal to said longitudinal axis attached to said other tubular member adjacent said second nozzle.

4. The combination as claimed in claim 3 wherein the pressure of said annular evacuated chamber is substantially in the order of one micron height of mercury.

5. The combination as claimed in claim 3 wherein said radial bellows includes a first annular wall concentrically disposed relative to said primary and secondary fuel passageways and a second annular wall concentrically disposed relative to said first annular wall and a convolute interconnecting said first annular wall and said second annular wall at one end and defining an open ended annular cavity for receiving ambient air therein.

6. The combination as claimed in claim 5 including said first nozzle having a complimentary tubular member defining an orifice for discharging primary fuel in said combustion zone, and said second nozzle having another complementary tubular member defining another orifice for discharging secondary fuel in said combustion zone, and bonding means for joining said first tubular member to said complementary tubular member and said second tubular member to said other complementary tubular member whereby said radial bellows relieves the thermal stress on said bonding means occasioned when said primary and/or secondary fuel flows through said orifice and/or said other orifice.

7. The combination as claimed in claim 6 wherein said fuel nozzle includes a frontal face portion, said housing having a depending portion defining said frontal face portion and enclosing one end of said evacuated cavity and means, in situ, for evacuating said cavity including an opening in said depending portion, and weld means for sealing said opening upon said cavity being evacuated.

* * * * *